US010627756B2

(12) United States Patent
Eiki et al.

(10) Patent No.: US 10,627,756 B2
(45) Date of Patent: Apr. 21, 2020

(54) FIXING DEVICE AND IMAGE FORMING APPARATUS

(71) Applicant: KYOCERA Document Solutions Inc., Osaka (JP)

(72) Inventors: Takashi Eiki, Osaka (JP); Hiroki Kawasaki, Osaka (JP); Atsushi Kohama, Osaka (JP); Yuhiro Sakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/509,214

(22) Filed: Jul. 11, 2019

(65) Prior Publication Data

US 2020/0019098 A1 Jan. 16, 2020

(30) Foreign Application Priority Data

Jul. 12, 2018 (JP) ..... 2018-132525

(51) Int. Cl.
*G03G 15/20* (2006.01)
*G03G 15/16* (2006.01)

(52) U.S. Cl.
CPC ..... *G03G 15/2053* (2013.01); *G03G 15/161* (2013.01); *G03G 15/2017* (2013.01); *G03G 2215/2003* (2013.01); *G03G 2215/207* (2013.01)

(58) Field of Classification Search
CPC ..... G03G 15/2053; G03G 15/2017; G03G 15/80; G03G 21/1652; G03G 2215/2003; G03G 2215/2035
See application file for complete search history.

(56) References Cited

U.S. PATENT DOCUMENTS 8,995,868 B2 3/2015 Moriya et al.
9,291,984 B2 3/2016 Moriya et al.
2002/0020693 A1* 2/2002 Otsuka ..... G03G 15/2053 219/216
2014/0105634 A1* 4/2014 Tanaka ..... G03G 15/2053 399/90
2014/0161479 A1* 6/2014 Yoshida ..... G03G 15/2053 399/90
2015/0277309 A1* 10/2015 Kuroda ..... G03G 15/2053 219/541

(Continued)

FOREIGN PATENT DOCUMENTS

JP 2013-235223 A 11/2013

*Primary Examiner* — Sophia S Chen
(74) *Attorney, Agent, or Firm* — Studebaker & Brackett PC

(57) ABSTRACT

A fixing device includes a cylindrical rotatable fixing belt, a flat heater, a heater holding part, a pressuring member, and a connector. In the flat heater, an electrode part, a feeder and a heat generating part are formed in the same face state. The heater holding part holds the flat heater so that the heat generating part faces to an inner circumference face of the fixing belt. The pressuring member sandwiches the fixing belt with the flat heater. The connector has a contacting portion coming into contact with the electrode part. The feeder has a portion arranged at a near side from the electrode part in an attaching direction of the connector. The heater holding part includes a protecting portion covering the portion of the feeder arranged at the near side from the electrode part.

16 Claims, 9 Drawing Sheets

(56) References Cited

U.S. PATENT DOCUMENTS

| | | | | |
|---|---|---|---|---|
| 2015/0341985 | A1* | 11/2015 | Nakayama | G03G 15/2053 219/216 |
| 2016/0011551 | A1* | 1/2016 | Nakayama | G03G 15/2053 399/69 |
| 2018/0253054 | A1* | 9/2018 | Tanto | G03G 15/2017 |
| 2019/0286028 | A1* | 9/2019 | Furuichi | G03G 15/2053 |

* cited by examiner

RELATED ART

RELATED ART

FIXING DEVICE AND IMAGE FORMING APPARATUS

INCORPORATION BY REFERENCE

This application is based on and claims the benefit of priority from Japanese Patent application No. 2018-132525 filed on Jul. 12, 2018, the entire contents of which are incorporated herein by reference.

BACKGROUND

The present disclosure relates to a fixing device fixing a toner image on a sheet and an image forming apparatus including this fixing device.

As one manner heating a fixing belt of a fixing device, a manner using a flat heater is known. The flat heater has a heat generating part having a longitudinal direction orthogonal to a conveying direction of a sheet, and is arranged so that the heat generating part faces to an inner circumference face of the fixing belt. The fixing belt is sandwiched between the flat heater and a pressuring roller.

A length in the longitudinal direction of the heat generating part is a length corresponding to the sheet of a maximum size and, if the sheet of a size smaller than it is used, heat consumption of both ends in the longitudinal direction through which the sheet does not pass is decreased. Thereupon, as shown in FIG. 8, a configuration is proposed, in which a plurality of heat generating parts 41 to 43 are arranged in the longitudinal direction and the heat generating part according to the size of the sheet is heated.

Concretely, the heat generating parts 41 to 43 have a plurality of resistance heat generating elements 40 arranged along one line parallel to the longitudinal direction. The heat generating part 41 is located at a center portion in the longitudinal direction and the heat generating parts 42 and 43 are located at both adjacent sides to it. At a side of the heat generating part 42, electrode parts 51 to 54 are arranged along one line parallel to the longitudinal direction. Feeders 61, 62 and 63 are respectively connected to right ends of the heat generating parts 41, 42 and 43 on a paper sheet of the figure. A feeder 64 is connected to left ends of the heat generating parts 41 to 43 on a paper sheet of the figure. The feeders 61, 62, 63 and 64 are respectively connected to the electrode parts 51, 52, 53 and 54. Further, a connector is attached at a position shifted to a right side from a left side of the electrode parts 51 to 54.

By contrast, as shown in FIG. 9, another configuration is proposed, in which the feeders 62 and 63 are connected to the electrode part 52 and the electrode part 53 is omitted so that a length in the longitudinal direction of the flat heater is shortened. However, in such a case, because the feeder 63 is arranged at a near side from the electrode parts 52 and 54 in an attaching direction of the connector, it is feared that the feeder 63 is scraped off by friction with a contacting portion of the connector when the connector is attached and conduction failure occurs.

Thereupon, conventionally, a technique of restraining conduction failure due to contact of the contacting portion and the flat heater when the connector is attached is researched. For example, a conventional connector includes a housing having an opening, and a contact terminal having a supporting face portion, a contacting portion and an engaging face portion and being electrically connected to an electrode part inserted in the opening by protruding operation to the opening. A restricting member pushes the contact terminal to retract the contacting portion from the opening, and thereby, restrict the contacting portion from coming into contact with a member inserted inside the opening, and separates the contact terminal to protrude the contacting portion to the opening.

However, the above-mentioned conventional configuration, a shape of the connector is complicated. Moreover, a size of the connector is enlarged.

SUMMARY

In accordance with the present disclosure, a fixing device includes a cylindrical rotatable fixing belt, a flat heater, a heater holding part, a pressuring member, and a connector. In the flat heater, an electrode part, a feeder and a heat generating part are formed in the same face state. The heater holding part holds the flat heater so that the heat generating part faces to an inner circumference face of the fixing belt. The pressuring member sandwiches the fixing belt with the flat heater. The connector has a contacting portion coming into contact with the electrode part. The feeder has a portion arranged at a near side from the electrode part in an attaching direction of the connector. The heater holding part includes a protecting portion covering the portion of the feeder arranged at the near side from the electrode part.

In accordance with the present disclosure, an image forming apparatus includes an image forming part forming a toner image on the sheet, and the fixing device as described above to fix the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the accompanying drawings, embodiments of an image forming apparatus and a fixing device of the present disclosure will be described.

Figure 1:
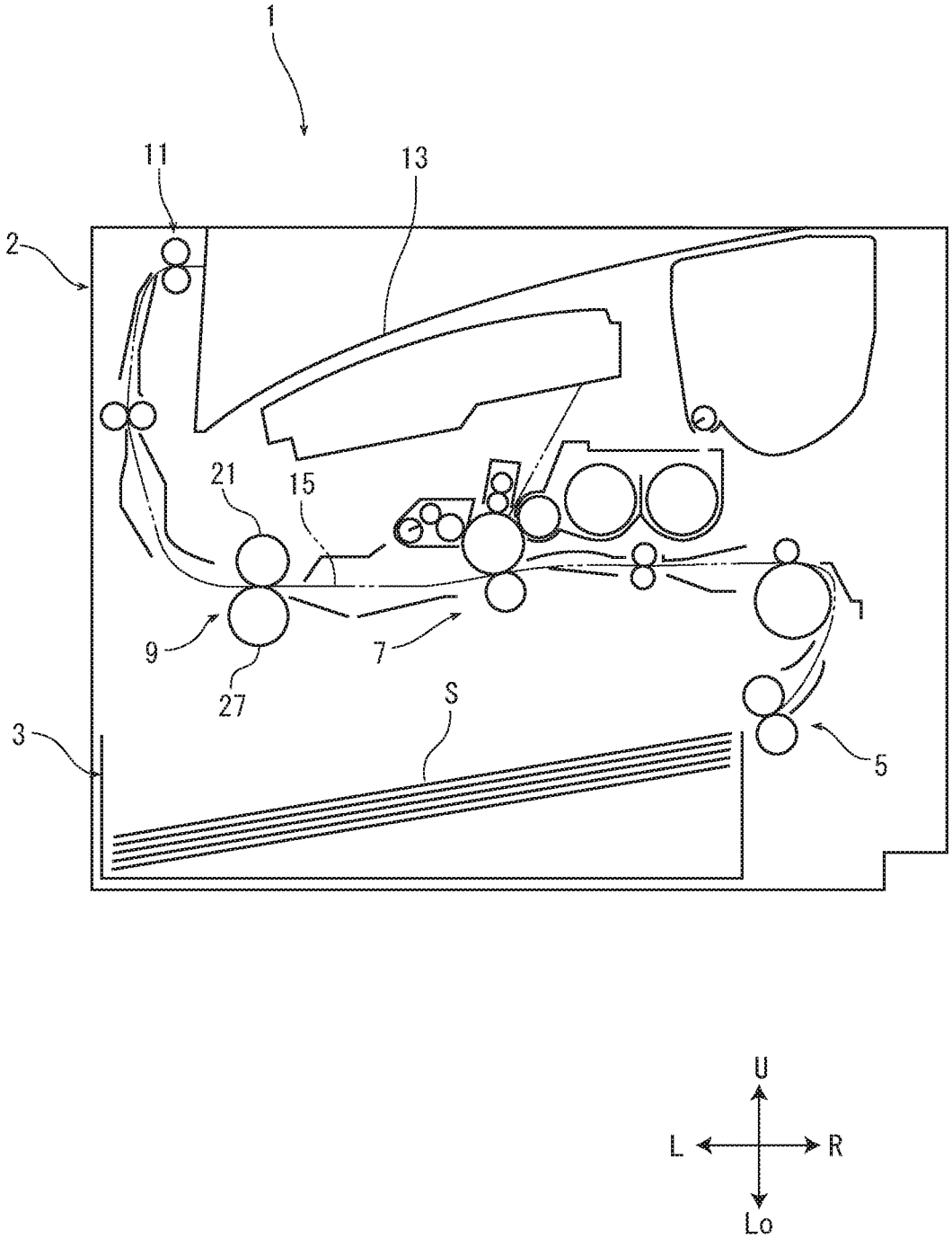
FIG. 1 is a sectional view schematically showing an internal structure of a printer according to an embodiment of the present disclosure.

First, the entire structure of a printer 1 as the image forming apparatus will be described with reference to FIG. 1. FIG. 1 is a sectional view schematically showing an internal structure of the printer 1. Hereinafter, it will be described so that the front side of the color printer 1 is positioned at a near side on a paper sheet of FIG. 1 and that left and right directions is defined as seen from the front side of the color printer 1. Arrows U, Lo, L, R, Fr and Rr in each of the drawings respectively indicate an upper side, a lower side, a left side, a right side, a front side and a rear side of the printer 1.

In an apparatus body 2 of the printer 1, a sheet feeding cartridge 3 storing sheets S, a sheet feeding device 5 feeding the sheet S from the sheet feeding cartridge 3, an image forming part 7 forming a toner image on the sheet S, a fixing device 9 fixing the toner image on the sheet S, a sheet ejecting device 11 ejecting the sheet S, and an ejected sheet tray 13 receiving the ejected sheet S are provided. Further, in the apparatus body 2, a conveying path 15 of the sheet S is arranged so as to run from the sheet feeding device 5 to the sheet ejecting device 11 through the image forming part 7 and the fixing device 9.

The sheet S fed from the sheet feeding cartridge 3 by the sheet feeding device 5 is conveyed to the image forming part 7 along the conveying path 15 and the toner image is formed on the sheet S. The sheet S is conveyed to the image fixing device 9 along the conveying path 15 and the toner image is fixed on the sheet S. The sheet S having the fixed toner is ejected from the sheet ejecting device 11 to the ejected sheet tray 13.

Figure 2:
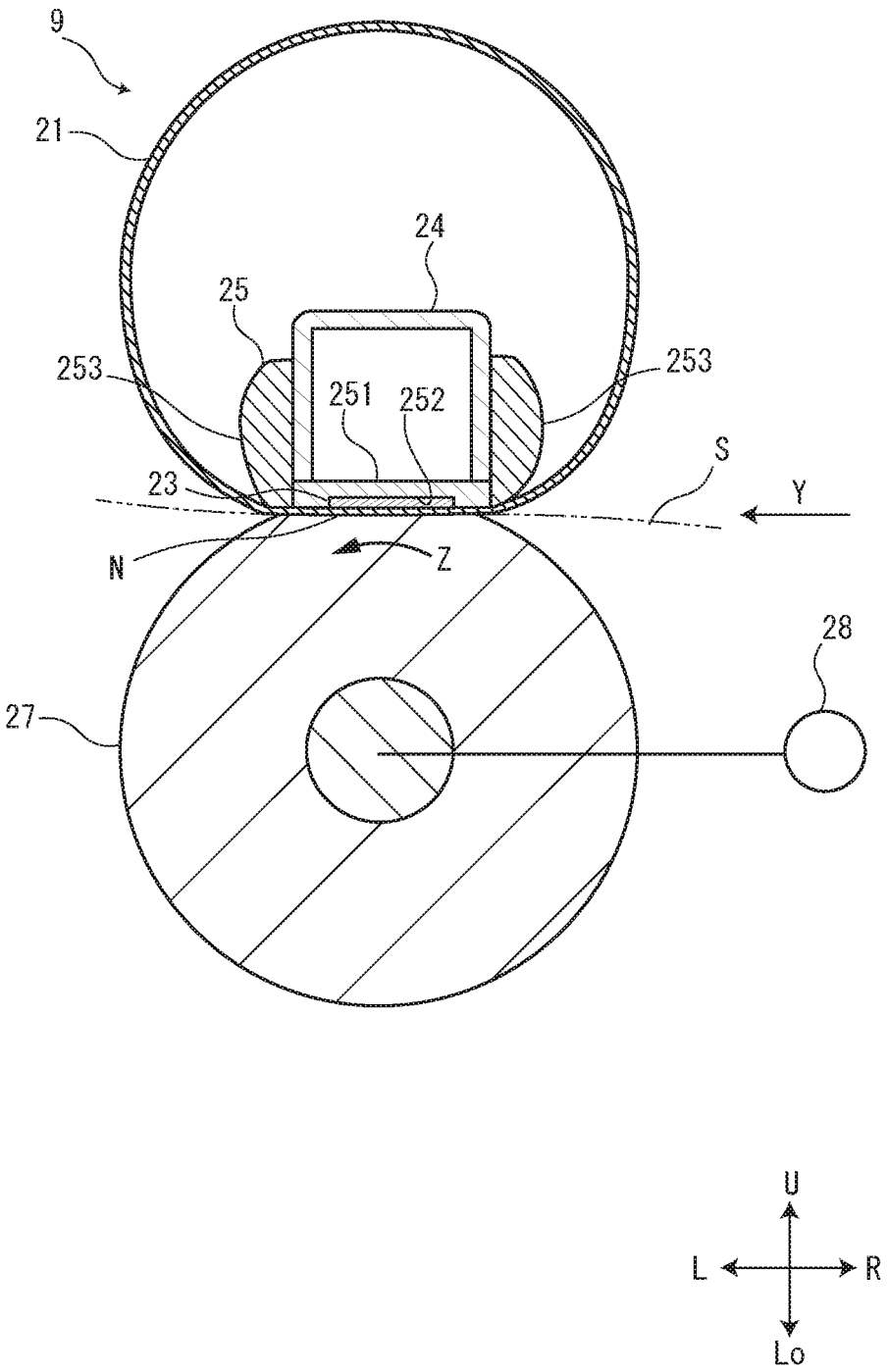
FIG. 2 is a sectional view showing a fixing device according to the embodiment of the present disclosure.
Figure 3:
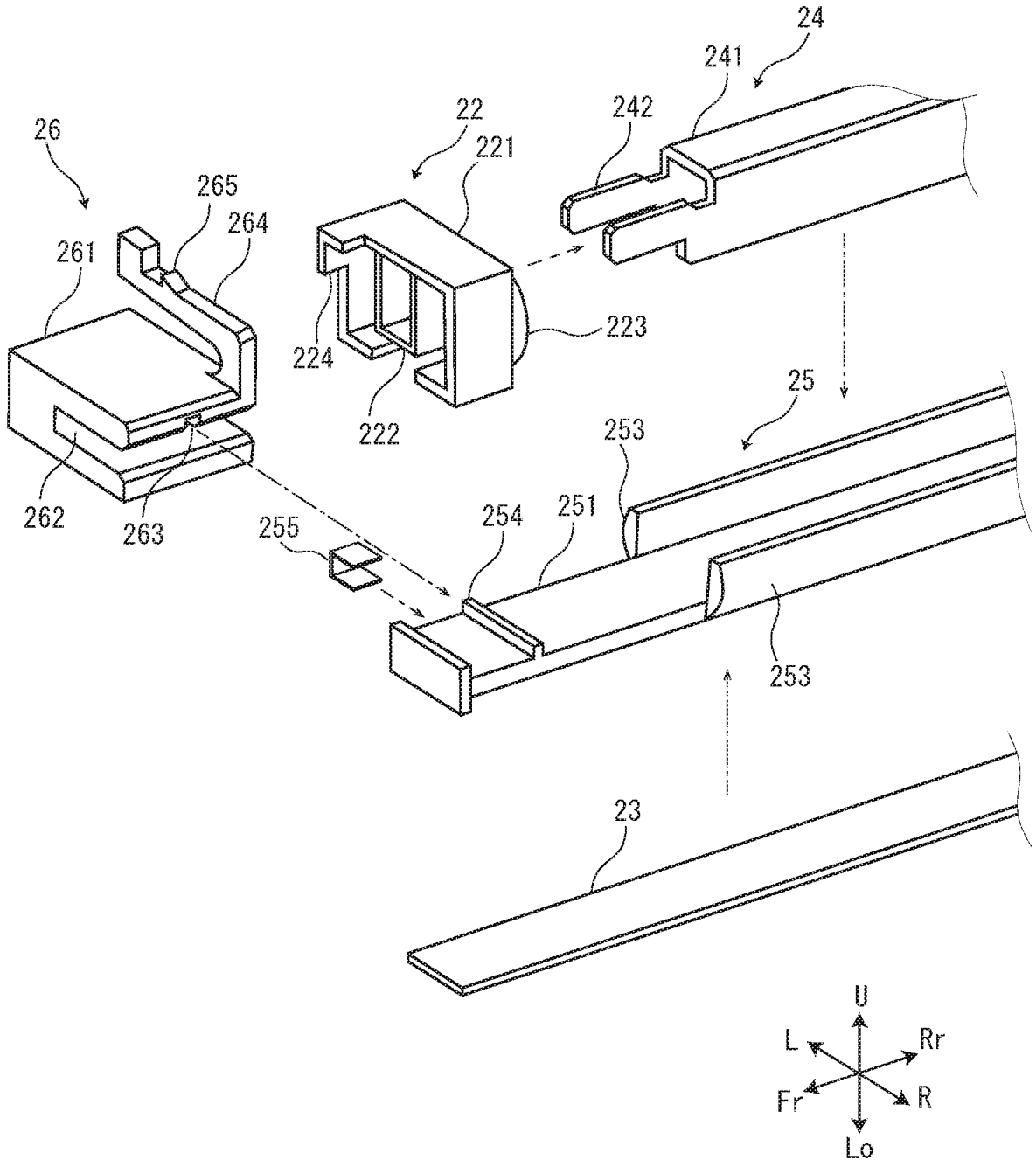
FIG. 3 is an exploded perspective view showing a heater holding member and the periphery in the fixing device according to the embodiment of the present disclosure.
Figure 4:
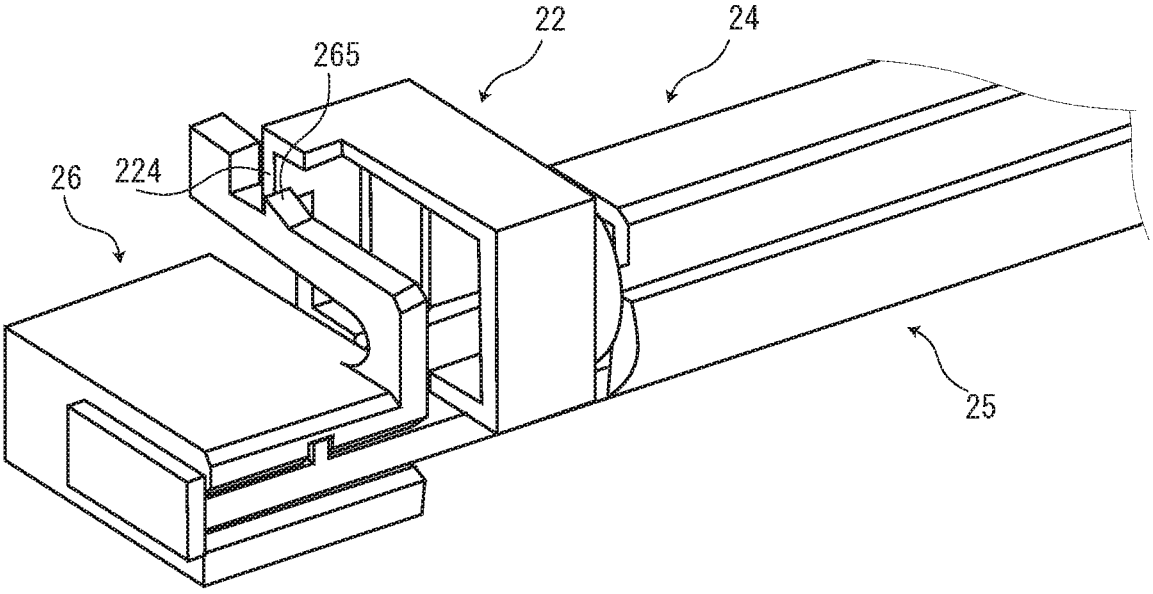
FIG. 4 is a perspective view showing the heater holding member and the periphery in the fixing device according to the embodiment of the present disclosure.
Figure 4:
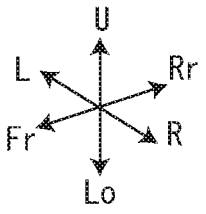
Figure 5:
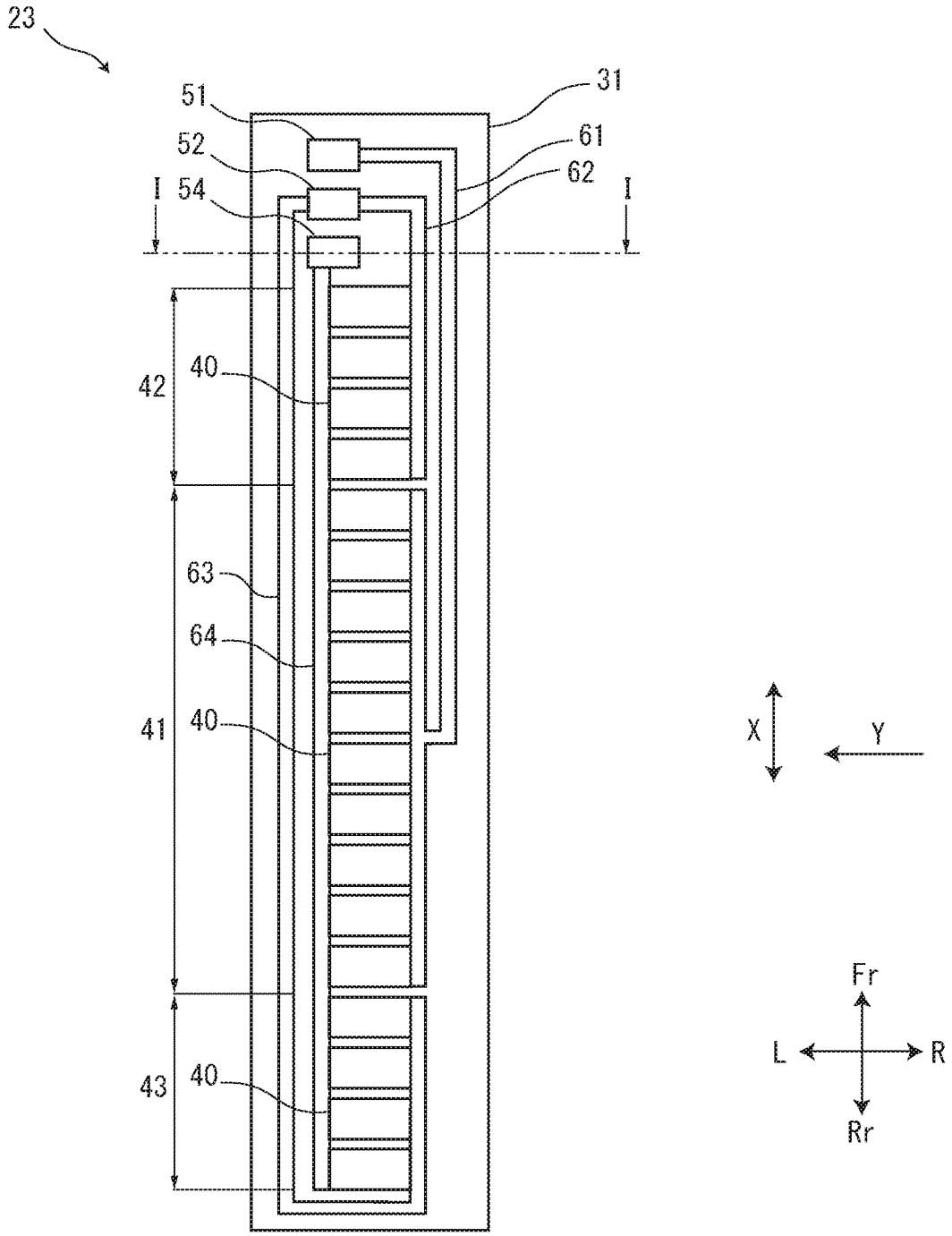
FIG. 5 is a lower face view showing a flat heater in the fixing device according to the embodiment of the present disclosure.
Figure 6A:
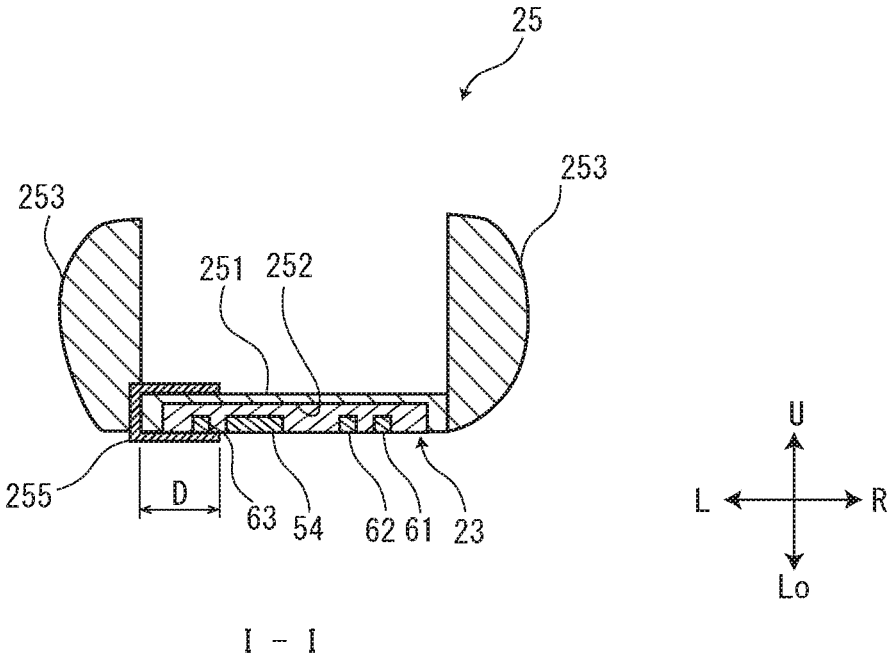
FIG. 6A is a sectional view showing the heater holding member and the flat heater along an I-I line in FIG. 5.
Figure 6B:
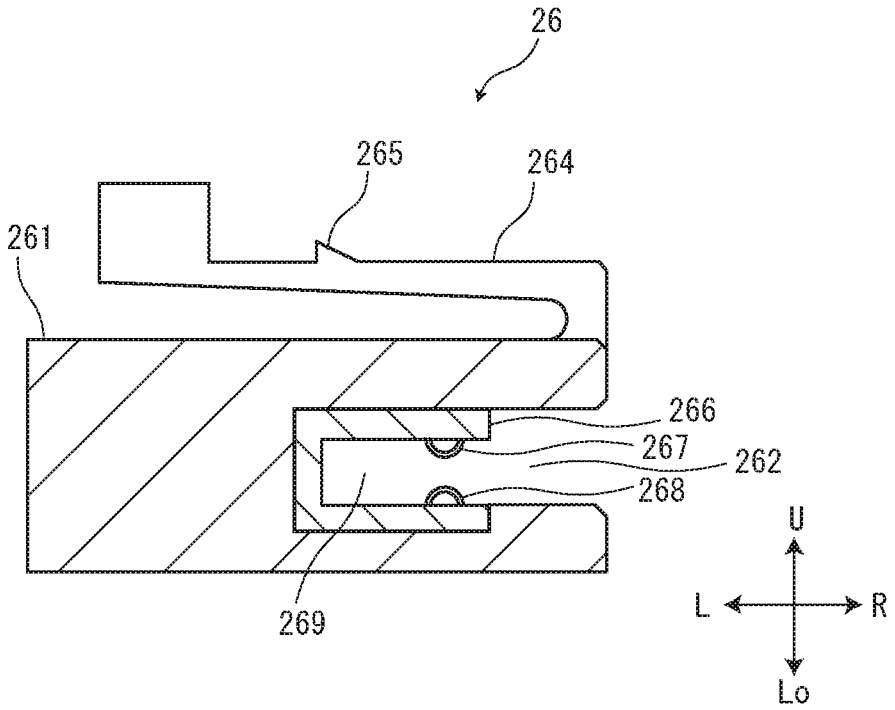
FIG. 6B is a sectional view showing a connector in the fixing device according to the embodiment of the present disclosure.

Next, the fixing device 9 will be described with reference to FIG. 2. FIG. 2 is a sectional view showing the fixing device 9. FIG. 3 is an exploded perspective view showing a heater holding member 25 and the periphery. FIG. 4 is a perspective view showing the heater holding member 25 and the periphery. FIG. 5 is a lower face view showing a flat heater 23. FIG. 6A is a sectional view showing the heater holding member 25 and the flat heater 23 along an I-I line in FIG. 5. FIG. 6B is a sectional view showing a connector 26.

The fixing device 9 includes a cylindrical shaped rotatable fixing belt 21, the flat heater 23, the heater holding member 25, a pressuring roller 27, and the connector 26. In the flat heater 23, electrode parts 51, 52 and 54, feeders 61 to 64, and heat generating parts 41 to 43 are formed in the same face state. The heater holding member 25 holds the flat heater 23 so that the heat generating parts 41 to 43 face to an inner circumference face of the fixing belt 21. The pressuring roller 27 sandwiches the fixing belt 21 with the flat heater 23. The connector 26 has contacting portions 267 and 268 coming into contact with the electrode parts 51, 52 and 54. The feeder 63 has a portion being arranged at a near side from the electrode parts 52 and 54 in an attaching direction of the connector 26, and the heater holding member 25 includes a protecting portion 255 covering the portion of the feeder 63 arranged at the near side from the electrode parts 52 and 54. In the following description, an "axial direction X" indicates an axial direction of the pressuring roller 27 (forward and backward directions). Although, in the present embodiment, an example of the fixing device 9 arranged in a posture that the pressuring roller 27 is located below the fixing belt 21, the fixing device 9 may be arranged in any of various postures.

As shown in FIG. 2, the fixing belt 21 is a cylindrical belt having a longitudinal direction along the axial direction X and having flexibility, and has a predetermined inner diameter, and its length in the longitudinal direction is longer than a width of the sheet S. The fixing belt 21 has a base material layer, an elastic layer provided around an outer circumference face of the base material layer, and a release layer provided around an outer circumference face of the elastic layer. The base material layer is made of metal, such as stainless steel or nickel alloy. The elastic layer is made of silicone rubber or the like. The release layer is made of PFA tube or the like. On an inner circumference face of the base material layer, a sliding layer may be formed. The sliding layer is made of polyamide-imido, PTFE or the like.

As shown in FIGS. 5 and 6A, the flat heater 23 is formed in a roughly rectangular plate shape having a longitudinal direction along the axial direction X. The flat heater 23 has a base material, a heat insulation layer 31, and a coat layer. The base material and the coat layer are omitted in the figures.

The base material is made of material, such as ceramic, with electrical insulation property, and is formed in a roughly rectangular plate shape having a longitudinal direction along the axial direction X. The heat insulation layer 31 is made of material, such as ceramic or glass, with electrical insulation property and low heat conductivity, and is laminated on a lower face of the base material. The heat insulation layer 31 restrains conducting of heat generated by the heat generating parts 41 to 43 to a side of the base material.

The heat generating parts 41 to 43 are made of material, such as metal, with electrical conductivity having a resistance value higher than the feeders 61 to 64, and are formed on a lower face of the heat insulation layer 31. The heat generating parts 41 to 43 are arranged along one line parallel to the axial direction X. Each of the heat generating parts 41 to 43 has a plurality of resistance heat generating elements 40 arranged along one line parallel to the axial direction X.

The heat generating part 41 is arranged within a range corresponding to a length of a longer side of the sheet S of a small size (e.g. JIS A5 size). The heat generating parts 42 and 43 are arranged within a range corresponding to a length of a longer side of the sheet S of a large size (e.g. JIS A4 size) where the heat generating part 41 is not arranged. The heat generating parts 42 and 43 are respectively located at a front side and a rear side of the heat generating part 41.

The feeders 61 to 64 are made of material, such as metal, with electrical conductivity having a resistance value lower than the resistance heat generating element 40, and are formed on the lower face of the heat insulation layer 31. The feeder 61 is connected to right ends (ends at an upstream side in a conveying direction Y of the sheet S) of the plurality of resistance heat generating elements 40 included in the heat generating part 41. The feeder 62 is connected to right ends of the plurality of resistance heat generating elements 40 included in the heat generating part 42. The feeder 63 is connected to right ends of the plurality of resistance heat generating elements 40 included in the heat generating part 43. On the other hand, the feeder 64 is connected to left ends (ends at a downstream side in the conveying direction Y) of the plurality of resistance heat generating elements 40 included in the heat generating parts 41 to 43. The electrode parts 51, 52 and 54 are located at a front side portion from the heat generating part 42 on the lower face of the heat insulation layer 31 in order of the electrode parts 51, 52, 54 from the front side.

The feeder 61 is connected to the electrode part 51, the feeders 62 and 63 are connected to the electrode part 52, and the feeder 64 is connected to the electrode part 54. However, although the feeders 61 and 62 are arranged at right side portions (at the upstream side in the conveying direction Y) from the heat generating parts 41 and 42, the feeder 63 is arranged from a right end of the heat generating part 43 through a rear side portion from the heat generating part 43 and left side portions (at the downstream side in the conveying direction Y) from the heat generating parts 43, 42 and 41 and the electrode parts 54 and 52, and is connected to the electrode part 52. Incidentally, on the lower face of the heat insulation layer 31, in portions in which the heat generating parts 41 to 43, the feeders 61 to 64 and the electrode parts 51 to 54 are not formed, the heat insulation layer 31 is laminated so as to form a flat face together with the heat generating parts 41 to 43, the feeders 61 to 64 and the electrode parts 51 to 54.

The coat layer covers a range in the longitudinal direction of the heat insulation layer 31 where the heat generating parts 41 to 43 are formed. The coat layer is made of, for example, material, such as ceramic, with electrical insulation property and small sliding friction force with respect to the fixing belt 21. A lower face of the coat layer comes into contact with the inner circumference face of the fixing belt 21.

As shown in FIGS. 2, 3 and 6A, the heater holding member 25 has a body portion 251 having a longitudinal direction along the axial direction X. A length in the longitudinal direction of the body portion 251 is longer than the length in the longitudinal direction of fixing belt 21. In a lower portion of the body portion 251, a recessed portion 252 having a longitudinal direction along the axial direction X is formed. The flat heater 23 is fitted into the recessed portion 252 in a posture that the heat generating parts 41 to 43 is located at a lower side. At left and right sides of the heater holding member 25, curved portions 253 with curvature slightly larger than curvature of the fixing belt 21 are formed, and the curved portions 253 and the flat heater 23 compose a smooth face coming into contact with the inner circumference face of the fixing belt 21. In an upper face of a front side end of the body portion 251, a protruded portion 254 extended in the left and right directions is formed. The heater holding member 25 is made of, for example, heat resistant resin, such as liquid crystal polymer.

As shown in FIGS. 3 and 6A, the heater holding member 25 includes the protecting portion 255. The protecting portion 255 has a recess penetrating in the forward and backward directions, and a height in upward and downward directions of the recess is roughly equal to a thickness of the heater holding member 25. A depth D in the left and right directions of the recess of the protecting portion 255 is equal to or more than a distance from a left end of the heater holding member 25 to a right end of the feeder 63 and equal to or less than a distance from a left end of the heater holding member 25 to a left end of the electrode part 54. That is, the recess of the protecting portion 255 has the depth covering a range from the left end of the heater holding member 25 to at least the feeder 63. The protecting portion 255 is made of, for example, material, such as a graphite sheet, with insulation property and high heat conductivity. Here, the high heat conductivity means heat conductivity higher than materials of the base material, the heat insulation layer 31 and the coat layer of the flat heater 23. For instance, in a case the base material, the heat insulation layer 31 and the coat layer of the flat heater 23 are made of ceramic (alumina), heat conductivity is equal to or more than 35 W/mK as a standard. The protecting portion 255 is stuck to the heater holding member 25 with, for example, a silicone adhesive or a heat resistant tape.

As shown in FIG. 2, the pressuring roller 27 has a core metal, an elastic layer provided around an outer circumference face of the core metal, and a release layer provided around an outer circumference face of the elastic layer. The elastic layer is made of silicon rubber or the like. The release layer is made of PFA tube or the like. The pressuring roller 27 sandwiches the fixing belt 21 with the flat heater 23 to form the pressuring area N between the fixing belt 21 and the pressuring roller 27. The pressuring roller 27 is driven by a motor 28 to make the fixing belt 21 co-rotate with the pressuring roller 27, and sandwiches and conveys the sheet S.

As shown in FIGS. 2 and 3, a pressing member 24 has a body portion 241 having a longitudinal direction along the axial direction X, and a pair of protruded portions 242 formed at both front and rear ends in the longitudinal direction of the body portion 241 and protruded in the longitudinal direction, and is arranged so as to penetrate a hollow portion of the fixing belt 21. The pressing member 24 is made of metal, such as stainless steel or aluminum alloy. The fixing belt 21 is supported by an arc-shaped belt guide (not shown) supported by the pressing member 24, and is rotatable along the belt guide.

As shown in FIG. 3, a belt holding member 22 is a roughly box-shaped member, and is located at both front and rear ends in the longitudinal direction of the pressing member 24. At the center of a body portion 221 of the belt holding member 22, a core portion 222 having a width corresponding to a distance between the pair of protruded portions 242 of the pressing member 24 is formed. In the body portion 221, at a side of the fixing belt 21, an arc portion 223 corresponding to the inner circumference face of the fixing belt 21 is formed, and the arc portion 223 is fitted into an end in the longitudinal direction of the fixing belt 21. At a front side of a left wall of the body portion 221, a protruded portion 224 is formed by cutting out its lower portion. The belt holding member 22 is fixed to a housing (not shown) of the fixing device 9. The belt holding member 22 is made of, for example, heat resistant resin, such as liquid crystal polymer.

As shown in FIGS. 3 and 6B, the connector 26 has a rectangular parallelepiped body portion 261 and, in a right side face of the body portion 261, a recessed portion 262 penetrating in the forward and backward directions is formed. In an upper side face of the recessed portion 262, a recessed portion 263 having a shape corresponding to the protruded portion 254 of the heater holding member 25 is formed. A lever 264 is formed so as to protrude from a right end of an upper portion of the body portion 261 to the upper side and to extend from an upper portion of its protruded portion to the left side, and has flexibility. In an upper portion of a portion extended to the left side in the lever 264, a projected portion 265 is formed. In the projected portion 265, an inclined portion having a downward gradient from the left side to the right side is formed. The body portion 261 and the lever 264 are made of, for example, heat resistant resin, such as liquid crystal polymer.

In the recessed portion 262, a terminal portion 266 is provided. The terminal portion 266 is a groove-shaped terminal having a recessed portion 269 penetrating in the forward and backward directions, and a thickness in the upward and downward directions of the recessed portion 269 is larger than a thickness of the body portion 251 of the heater holding member 25. In an inner face at an upper side of the recessed portion 269, a contacting portion 267 protruded to the lower side is provided and, in an inner face at a lower side of the recessed portion 269, a contacting portion 268 protruded to the upper side is provided. The contacting portions 267 and 268 are plate spring-shaped contacts having flexibility, and can be respectively pushed to the upper side and the lower side.

Figure 7A:
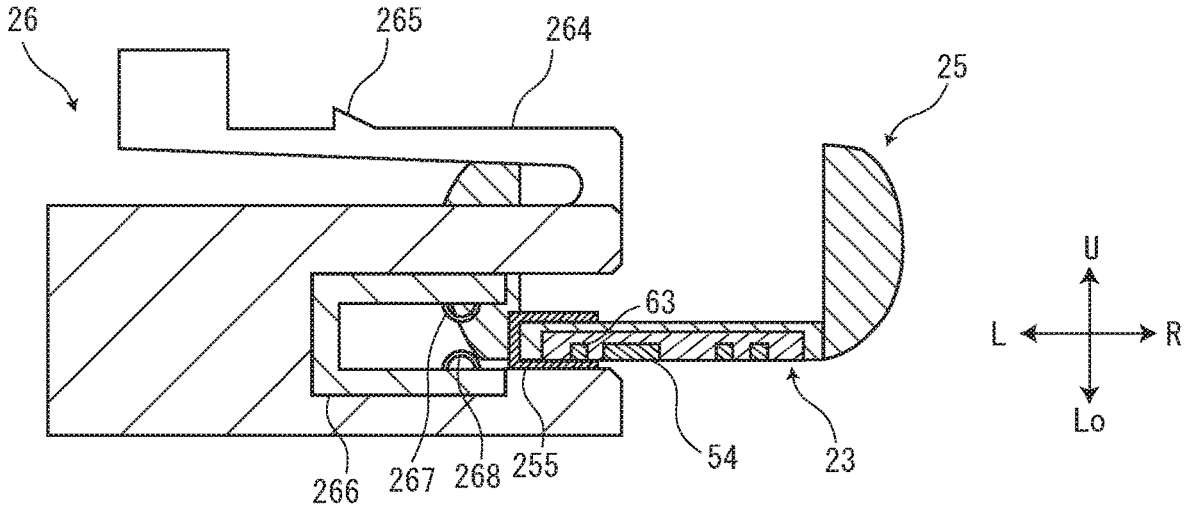
FIG. 7A is a sectional view showing the flat heater and the connector in the fixing device according to the embodiment of the present disclosure.
Figure 7B:
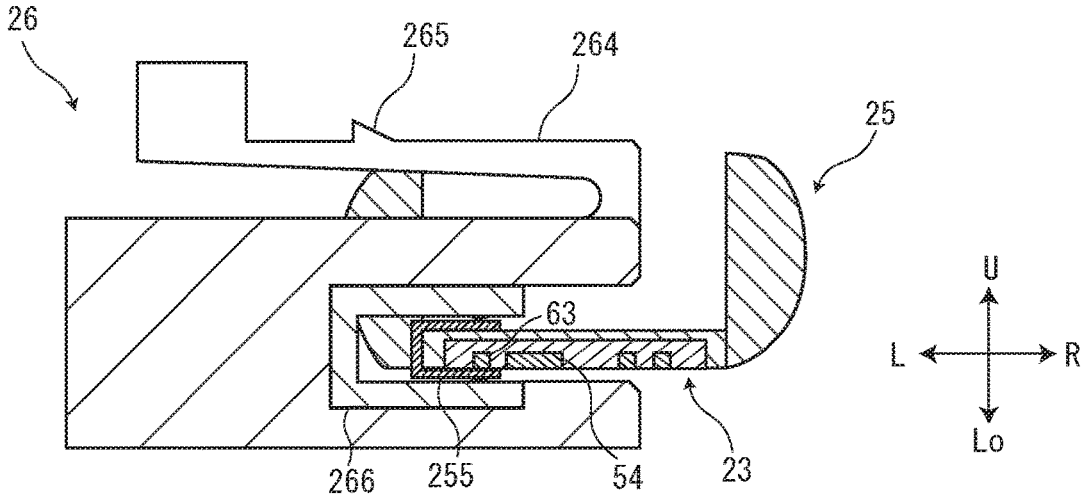
FIG. 7B is a sectional view showing the flat heater and the connector in the fixing device according to the embodiment of the present disclosure.
Figure 7C:
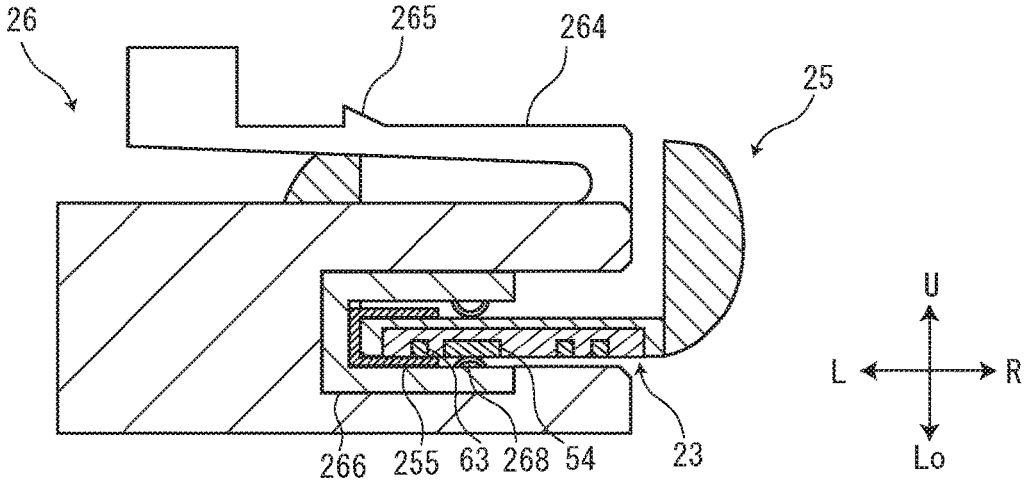
FIG. 7C is a sectional view showing the flat heater and the connector in the fixing device according to the embodiment of the present disclosure.
Figure 8:
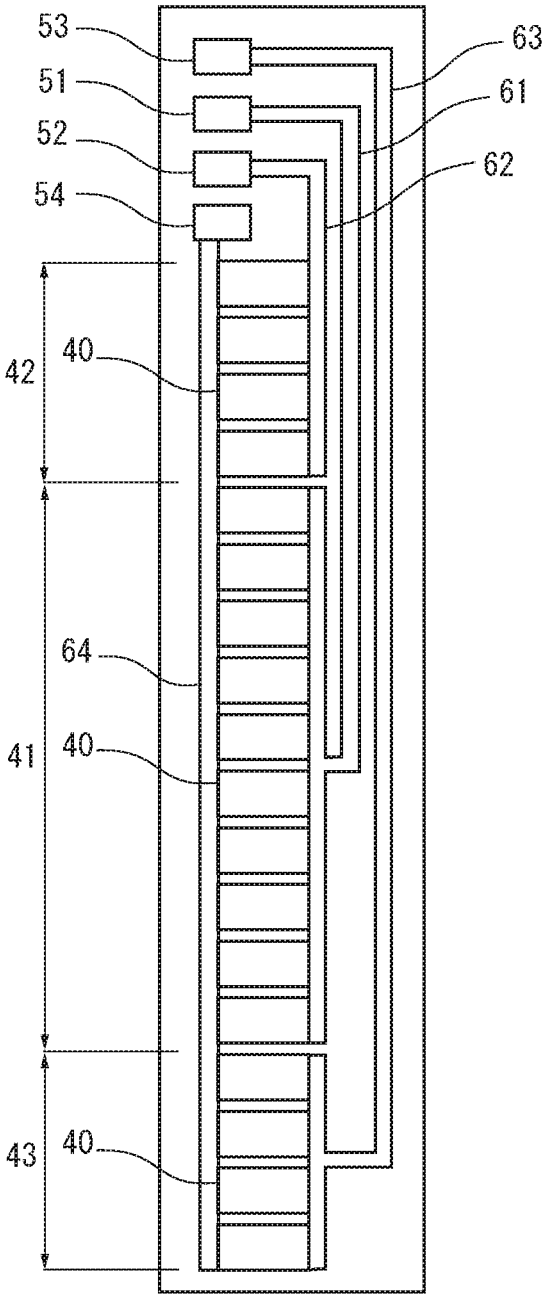
FIG. 8 is a lower face view showing a flat heater of a related art.
Figure 9:
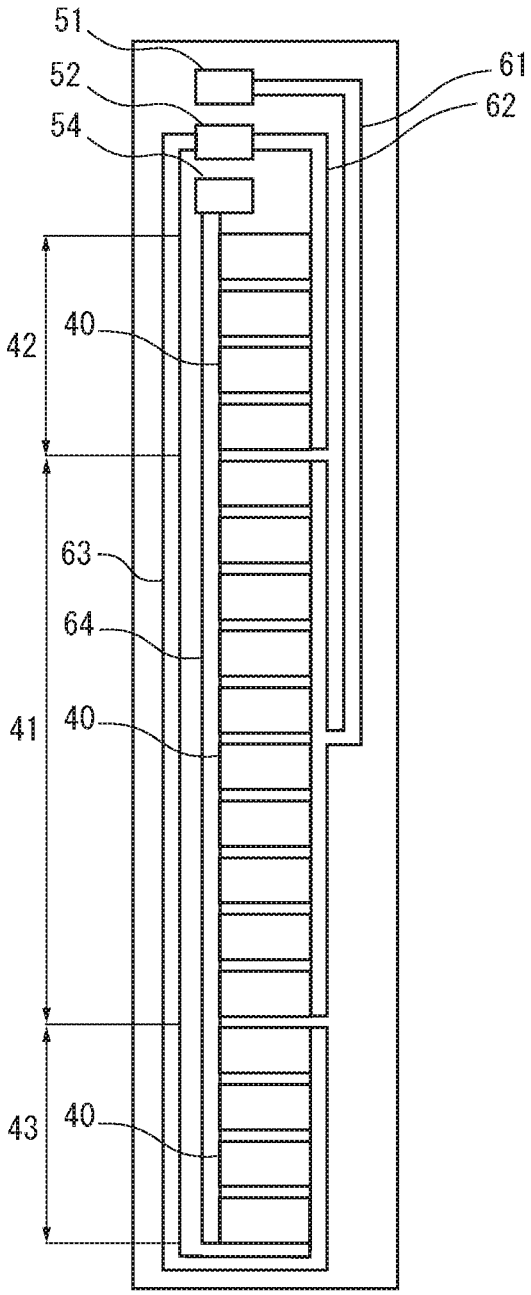
FIG. 9 is a lower face view showing a flat heater of a related art.

Next, with reference to FIGS. 3, 6A, 7A to 7C, procedure combining the above-described components will be described. FIGS. 7A to 7C are sectional views showing conditions that the connector 26 is attached to the heater holding member 25.

Firstly, as shown in FIGS. 3 and 6A, into the recessed portion 252 of the heater holding member 25, the flat heater 23 is fitted and, to the heater holding member 25 into which the flat heater 23 is fitted, the protecting portion 255 is attached.

Subsequently, as shown in FIG. 4, on an upper portion of the heater holding member 25, the pressing member 24 is located and, between the pair of protruded portions 242 of the pressing member 24, the core portion 222 of the belt holding member 22 is sandwiched.

And then, as shown in FIG. 3, to the protruded portion 254 of the heater holding member 25, the recessed portion 263 of the connector 26 is matched and, as shown in FIG. 7A, the connector 26 is moved from the left side to the right side with respect to the heater holding member 25.

When the connector 26 is further pushed, as shown in FIG. 7B, the contacting portions 267 and 268 are respectively pushed to the upper side and the lower side by the protecting portion 255. Although the feeder 63 has the portion arranged at the near side from the electrode parts 52 and 54 in the attaching direction of the connector 26, since the portion is covered by the protecting portion 255, it is not feared that the portion is scraped off by friction with the contacting portion 268. At this time, the inclined portion of the projected portion 265 of the lever 264 comes into contact with the protruded portion 224 of the belt holding member 22, and the lever 264 is warped to the lower side.

When the connector 26 is furthermore pushed, as shown in FIG. 7C, the protecting portion 255 passes over the contacting portions 267 and 268 and a left end of the protecting portion 255 reaches a deepest portion of the recessed portion 269 of the terminal portion 266. At this time, the contacting portions 267 and 268 are changed from pushed states to respective states protruded to the lower side and the upper side, and the contacting portion 268 comes into contact with the electrode parts 51, 52 and 54. At this time, the projected portion 265 of the lever 264 passes over the protruded portion 224 of the belt holding member 22 and moves to the right side of the protruded portion 224, and then, warp of the lever 264 is released. Movement of the projected portion 265 to the left side is restricted by the protruded portion 224, and then, the connector 26 is fixed. Incidentally, in order to detach the connector 26 from the heater holding member 25, by pushing the lever 264 to the lower side, the connector 26 may be moved to the left side.

A fixing operation of the fixing device 9 having the above-described configuration will be described. When the pressuring roller 27 is driven and rotated in a predetermined rotating direction Z, the fixing belt 21 is co-rotated with the pressuring roller 27 in an opposite rotating direction to the rotating direction Z of the pressuring roller 27, and the inner circumference face of the fixing belt 21 is slide with respect to the flat heater 23. When power is supply to the heat generating parts 41 to 43 of the flat heater 23, the heat generating parts 41 to 43 generate heat to heat the fixing belt 21. After temperature of the fixing belt 21 reaches predetermined temperature, the sheet S on which the toner is transferred is conveyed to the pressuring area N. In the pressuring area N, the sheet S is sandwiched between the fixing belt 21 and the pressuring roller 27 and conveyed. At this time, the toner is heated and pressured by the fixing belt 21, and them, the toner is fixed on the sheet S. The sheet S on which the toner is fixed is separated from the fixing belt 21 and conveyed along the conveying path 15.

As described above, in accordance with the present embodiment, the feeder 63 arranged at the near side from the electrode parts 52 and 54 in the attaching direction of the connector 26 is covered by the protecting portion 255. Therefore, according to the embodiment, without using a connector having a complicated shape, it is possible to protect the feeder 63 arranged at the near side from the electrode parts 52 and 54 in the attaching direction of the connector 26. Moreover, according to the embodiment, since the protecting portion 255 is made of material having high heat conductivity, it is possible to restrain temperature rise of the portion covered by the protecting portion 255.

Although, in the present embodiment, an example attaching the protecting portion 255 formed in a shape shown in FIG. 6A to the heater holding member 25, the present disclosure is not limited by the protecting portion 255 formed in such a shape. For instance, in a modified example, a bendable protecting portion 255 formed in a sheet-shape may be stuck to the heater holding member 25.

Although, in the present embodiment, an example providing the protecting portion 255 and the heater holding member 25 as different members is described, in a modified example, the protecting portion 255 may be integrally formed with the heater holding member 25. For instance, after the feeder 63 is formed on the heat insulation layer 31, on its lower face, material having insulation property and high heat conductivity may be laminated, and thereby, the protecting portion 255 may be formed. In such a case, the protecting portion 255 only needs to have an area covering at least the feeder 63.

Although, in the present embodiment, an example that the flat heater 23 has three heat generating parts 41 to 43 is described, in a modified example, regardless of the number of the heat generating parts of the flat heater 23, the present disclosure may be applied in a case where the feeder has the portion arranged at the near side from the electrode parts in the attaching direction of the connector.

Although, in the present embodiment, a case where the present disclosure is applied to the printer 1 has been described as one example, the disclosure is not restricted by this, but may be applied to a copying machine, a facsimile, a multifunction peripheral or the like.

The above-description of the embodiment of the present disclosure was described about a preferable embodiment of the fixing device and the image forming apparatus according to the disclosure. However, the technical scope of the present disclosure is not limited to the embodiments.

The invention claimed is:

1. A fixing device comprising:

a cylindrical rotatable fixing belt being long in an axial direction;

a flat heater in which an electrode part, a feeder and a heat generating part are formed in the same face state;

a heater holding part holding the flat heater so that the heat generating part faces to an inner circumference face of the fixing belt;

a pressuring member being long in the axial direction and sandwiching the fixing belt with the flat heater; and a connector having a contacting portion coming into contact with the electrode part and being attached to the heater holding part along a face on which the electrode part is formed in a direction orthogonal to the axial direction, wherein the heat generating part includes a first heat generating part arranged at a center in the axial direction within a range corresponding to a small size sheet and second heat generating parts at both sides from the first heat generating part in the axial direction within a range corresponding to a large size sheet, the electrode part includes a first electrode part connecting to the first heat generating part by a first feeder, a second electrode part connecting to the second heat generating parts respectively by a second feeder and a third feeder, and a third electrode part connecting to the third heat generating part by a fourth feeder, the first electrode part, the second electrode part, and the third electrode part being arranged in parallel along the axial direction at one end side in the axial direction, the first feeder is arranged at a far side from the first electrode part in an attaching direction of the connector, the second feeder is connected to the second heat generating part at one end side in the axial direction and arranged at a far side from the second electrode part in the attaching direction of the connector, and the fourth feeder is arranged at another end side from the third electrode part in the axial direction, the third feeder is connected to the second heat generating part at the another end side in the axial direction and has a portion arranged at a near side from the second electrode part in an attaching direction of the connector, the heater holding part includes a protecting portion covering the portion of the third feeder arranged at the near side from the second electrode part.

2. The fixing device according to claim 1, wherein the protecting portion is integrally formed with the heater holding member.

3. An image forming apparatus comprising:

an image forming part forming a toner image on a sheet; and the fixing device according to claim 2 to fix the toner image on the sheet.

4. The fixing device according to claim 1, wherein the protecting portion is a different member from the heater holding member.

5. An image forming apparatus comprising:

an image forming part forming a toner image on a sheet; and the fixing device according to claim 4 to fix the toner image on the sheet.

6. The fixing device according to claim 1, wherein the protecting portion has insulation property and high heat conductivity.

7. An image forming apparatus comprising:

an image forming part forming a toner image on a sheet; and the fixing device according to claim 6 to fix the toner image on the sheet.

8. The fixing device according to claim 1, wherein the connector has a recessed portion penetrating in the axial direction, the attaching direction of the connector is orthogonal to the axial direction, the connector is attached to the heater holding part by fitting the heater holding part holding the flat heater into the recessed portion.

9. The fixing device according to claim 8, wherein as the contacting portion, two contacting portions are respectively provided on an upper inner face and a lower inner face of the recessed portion so as to protrude to a lower side and an upper side.

10. An image forming apparatus comprising:

an image forming part forming a toner image on a sheet; and the fixing device according to claim 9 to fix the toner image on the sheet.

11. An image forming apparatus comprising:

an image forming part forming a toner image on a sheet; and the fixing device according to claim 8 to fix the toner image on the sheet.

12. An image forming apparatus comprising:

an image forming part forming a toner image on a sheet; and the fixing device according to claim 1 to fix the toner image on the sheet.

13. A fixing device comprising:

a cylindrical rotatable fixing belt;

a flat heater in which an electrode part, a feeder, and a heat generating part are formed in the same face state;

a heater holding part holding the flat heater so that the heat generating part faces to an inner circumference face of the fixing belt;

a pressuring member sandwiching the fixing belt with the flat heater; and a connector having a contacting portion coming into contact with the electrode part, wherein the feeder has a portion arranged at a near side from the electrode part in an attaching direction of the connector, the heater holding part includes a protecting portion covering the portion of the feeder arranged at the near side from the electrode part, and the protecting portion has insulation property and high heat conductivity.

14. An image forming apparatus comprising:

an image forming part forming a toner image on a sheet; and the fixing device according to claim 13 to fix the toner image on the sheet.

15. A fixing device comprising:

a cylindrical rotatable fixing belt;

a flat heater in which an electrode part, a feeder, and a heat generating part are formed in the same face state;

a heater holding part holding the flat heater so that the heat generating part faces to an inner circumference face of the fixing belt;

a pressuring member sandwiching the fixing belt with the flat heater; and a connector having a contacting portion coming into contact with the electrode part, wherein the feeder has a portion arranged at a near side from the electrode part in an attaching direction of the connector, the heater holding part includes a protecting portion covering the portion of the feeder arranged at the near side from the electrode part, the connector has a recessed portion penetrating in an axial direction, the attaching direction of the connector is orthogonal to the axial direction, the connector is attached to the heater holding part by fitting the heater holding part holding the flat heater into the recessed portion, and as the contacting portion, two contacting portions are respectively provided on an upper inner face and a lower inner face of the recessed portion so as to protrude to a lower side and an upper side.

16. An image forming apparatus comprising:

an image forming part forming a toner image on a sheet; and the fixing device according to claim 15 to fix the toner image on the sheet.

* * * * *